US009631261B2

(12) United States Patent
Fanning

(10) Patent No.: US 9,631,261 B2
(45) Date of Patent: Apr. 25, 2017

(54) LOW-COST ALPHA-BETA TITANIUM ALLOY WITH GOOD BALLISTIC AND MECHANICAL PROPERTIES

(75) Inventor: John Fanning, Henderson, NV (US)

(73) Assignee: TITANIUM METALS CORPORATION, Exton, PA (US)

( * ) Notice: Subject to any disclaimer, the term of this patent is extended or adjusted under 35 U.S.C. 154(b) by 518 days.

(21) Appl. No.: 12/850,691

(22) Filed: Aug. 5, 2010

(65) Prior Publication Data

US 2012/0202085 A1 Aug. 9, 2012

(51) Int. Cl.
*C22C 14/00* (2006.01)
*F41H 5/00* (2006.01)

(52) U.S. Cl.
CPC ..... *C22C 14/00* (2013.01); *F41H 5/00* (2013.01); *Y10T 428/12* (2015.01)

(58) Field of Classification Search
CPC ..... C22C 14/00; F41H 5/00; Y10T 428/12
USPC ..... 420/418, 420; 148/421, 557; 428/544; 164/47, 76.1
See application file for complete search history.

(56) References Cited

U.S. PATENT DOCUMENTS

| | | | |
|---|---|---|---|
| 3,436,277 | A | 4/1969 | Bomberger, Jr. et al. |
| 4,067,734 | A | 1/1978 | Curtis et al. |
| 4,299,626 | A | 11/1981 | Paton et al. |
| 4,898,624 | A | 2/1990 | Chakrabarti et al. |
| 4,943,412 | A | 7/1990 | Bania et al. |
| 5,219,521 | A | 6/1993 | Adams et al. |
| 5,332,545 | A | 7/1994 | Love |
| 5,358,686 | A | 10/1994 | Parris et al. |
| 5,362,441 | A | 11/1994 | Ogawa et al. |
| 5,516,375 | A | 5/1996 | Ogawa et al. |
| 5,679,183 | A | 10/1997 | Takagi et al. |
| 5,861,070 | A | 1/1999 | Reichman et al. |
| 5,980,655 | A | 11/1999 | Kosaka |
| 6,001,495 | A | 12/1999 | Bristow et al. |
| 6,228,189 | B1 | 5/2001 | Oyama et al. |
| 6,786,985 | B2 | 9/2004 | Kosaka et al. |
| 6,800,243 | B2 | 10/2004 | Tetyukhin et al. |
| 7,008,489 | B2 | 3/2006 | Bania |
| 2006/0045789 | A1 | 3/2006 | Nasserrafi et al. |
| 2008/0181809 | A1 | 7/2008 | Vladislav et al. |
| 2010/0178996 | A1 | 7/2010 | Chao |

FOREIGN PATENT DOCUMENTS

| | | | |
|---|---|---|---|
| JP | 03134124 A | * | 6/1991 |
| JP | H04103737 | | 4/1992 |
| JP | H0559510 | | 3/1993 |
| JP | 5195120 | | 8/1993 |
| JP | H05279773 | | 10/1993 |
| JP | 2001115221 | | 4/2001 |
| WO | WO 2004101838 | | 11/2004 |

OTHER PUBLICATIONS

Koyoku et al., English translation of JP 03-134124, Jun. 1991, whole document.*
International Search Report for International Application No. PCT/US11/46676—Date of Completion of Search: Mar. 23, 2012—2 pages, mailed Apr. 5, 2012.
Written Opinion of the International Searching Authority for International Application No. PCT/US11/46676—Date of Completion of Opinion: Mar. 23, 2012—4 pages, mailed Apr. 5, 2012.
U.S. Department of Defense specifications in "Detail Specification: Armor Plate, Titanium Alloy, Weldable," MIL-DTL-46077G, 2006.
U.S. Department of Defense test procedures in "Military Standard: V50 Ballistic Test for Armor," MIL-STD-662E, 1987.
J.C. Fanning in "Ballistic Evaluation of TIMETAL 6-4 Plate for Protection Against Armor Piercing Projectiles," in Proceedings of the Ninth World Conference on Titanium, vol. II, pp. 1171-1178 (1999).

* cited by examiner

*Primary Examiner* — Roy King
*Assistant Examiner* — Caitlin Kiechle
(74) *Attorney, Agent, or Firm* — Burris Law, PLLC

(57) ABSTRACT

An alpha-beta Ti alloy having improved mechanical and ballistic properties formed using a low-cost composition is disclosed. In one embodiment, the Ti alloy composition, in weight percent, is 4.2 to 5.4% aluminum, 2.5 to 3.5% vanadium, 0.5 to 0.7% iron, 0.15 to 0.19% oxygen and balance titanium. The exemplary Ti alloy exhibits a tensile yield strength of at least about 120,000 psi and an ultimate tensile strength of at least about 128,000 psi in both longitudinal and transverse directions, a reduction in area of at least about 43%, an elongation of at least about 12% and about a 0.430-inch-thick plate has a $V_{50}$ ballistic limit of about 1936 fps. The Ti alloy may be manufactured using a combination of recycled and/or virgin materials, thereby providing a low-cost route to the formation of high-quality armor plate for use in military systems.

24 Claims, 5 Drawing Sheets

LOW-COST ALPHA-BETA TITANIUM ALLOY WITH GOOD BALLISTIC AND MECHANICAL PROPERTIES

BACKGROUND OF THE INVENTION

I. Field of the Invention

This disclosure relates generally to titanium (Ti) alloys. In particular, alpha-beta Ti alloys having an improved combination of ballistic and mechanical properties achieved with a relatively low-cost composition are described as well as methods of manufacturing the Ti alloys.

II. Background of the Related Art

Ti alloys have found widespread use in applications requiring high strength-to-weight ratios, good corrosion resistance and retention of those properties at elevated temperatures. Despite these advantages, the higher raw material and processing costs of Ti alloys compared to steel and other alloys have severely limited their use to applications where the need for improved efficiency and performance outweigh their comparatively higher cost. Some typical applications which have benefited from the incorporation of Ti alloys in various capacities include, for example, aircraft components, medical devices, high-performance automobiles, premium sports equipment and military applications.

A conventional Ti-base alloy which has been successfully used in military systems is Ti-6Al-4V which is also known as Ti64. As the name suggests, these Ti alloys generally comprise 6 wt. % aluminum (Al) and 4 wt. % vanadium (V) with up to 0.30 wt. % iron (Fe) and up to 0.30 wt. % oxygen (O) typically included.

The development of Ti64 provided an alloy having an attractive combination of ballistic and mechanical properties for military ground vehicle systems. Military applications which implement a weldable wrought titanium alloy such as Ti64 as structural armor plate typically have strict compositional and performance requirements. For example, in a document entitled "Detail Specification: Armor Plate, Titanium Alloy, Weldable," MIL-DTL-46077G, 2006 the U.S. Department of Defense identified provisions for four classes of Ti64 wrought titanium alloy armor defined by strict elemental composition ranges and density requirements, as well as minimum mechanical and ballistic properties. With regard to Ti alloy-based armor plate, the goal is therefore to provide Ti alloys which meet or exceed established standards while minimizing the associated raw material and processing costs.

A number of approaches have been followed in attempting to produce Ti alloys having the required combination of properties at reduced cost. For example, Ti alloys have been produced by electron-beam single-melting (EBSM). This approach has made the manufacture of Ti alloys more cost-effective and enabled their implementation in additional military systems. Another approach focused on the substitution of a quantity of iron (Fe) in place of vanadium (V) as a beta stabilizer in the Ti alloy to reduce raw material costs as disclosed, for example, by U.S. Pat. No. 6,786,985 to Kosaka, et al. (hereinafter "Kosaka"). However, the Ti alloy developed by Kosaka required the inclusion of molybdenum (Mo).

Yet another approach has involved developing Ti alloy compositions which permit processing from ingot to final mill product at temperatures entirely within the beta-phase region of the alloy as disclosed, for example, in U.S. Pat. No. 5,342,458 to Adams, et al. ("Adams"). Adams states that the higher ductility and lower flow stresses which exist at higher temperatures in the described alloys minimize surface and end cracking, therefore increasing yield. U.S. Pat. No. 5,980,655 to Yoji Kosaka and U.S. Pat. No. 5,332,545 to William W. Love disclose approaches wherein Ti64 alloys having improved mechanical and ballistic properties were formed by increasing the oxygen concentration beyond the ranges which were specified by standard military guidelines.

A number of Ti alloys having compositions analogous to Ti64, but with additional components included therein are also known in the art. These Ti alloys were developed to provide, among other things, low-cost high strength Ti alloys with acceptable levels of ductility. An example is provided by U.S. Pat. No. 7,008,489 to Paul J. Bania which, in one embodiment, discloses a Ti alloy having at least a 20% improvement in ductility at a given strength level. However, in addition to the base Ti—Al—V—Fe—O components present in Ti64, the disclosed alloy also includes concentrations of tin (Sn), zirconium (Zr), chromium (Cr), molybdenum (Mo), and silicon (Si). The large number of elements present in these alloys necessarily increases the raw material costs of the thus-formed Ti alloy.

Another example is provided by U.S. Patent Appl. Publ. No. 2006/0045789 to Nasserrafi, et al. ("Nasserrafi") directed to Ti alloys that can be manufactured from recycled titanium. In one embodiment, Nasserrafi discloses a Ti alloy comprising Ti—Al—V; however, the alloy also includes one or more elements selected from the group consisting of Cr, Fe and manganese (Mn) in concentrations from 1.0 to 5.0 weight percent. The relatively high levels of Cr, Fe and Mn and low ductility limit the alloy's applicability to military systems. Each of the aforementioned patents and patent applications are incorporated by reference in their entirety as if fully set forth in this specification.

Despite the improvements from the standpoint of composition, properties and processing costs which have been attained to date, there is a continuing need to develop new and improved Ti alloys and associated manufacturing methods which achieve minimum mechanical and ballistic performance standards at continually lower cost.

SUMMARY OF THE INVENTION

A Ti alloy having a good combination of ballistic and mechanical properties which is achieved using a low cost composition is disclosed. Such a Ti alloy is particularly advantageous for use as armor plate in military applications, but is not so limited and may be suitable for a multitude of other applications. In one embodiment the Ti alloy consists essentially of, in weight percent, 4.2 to 5.4% aluminum, 2.5 to 3.5% vanadium, 0.5 to 0.7% iron, 0.15 to 0.19% oxygen and balance titanium. In a particular embodiment, the Ti alloy consists essentially of, in weight percent, about 4.8% aluminum, about 3.0% vanadium, about 0.6% iron, about 0.17% oxygen and balance titanium. In yet another embodiment, the maximum concentration of any one impurity element present in the titanium alloy is 0.1 wt. % and the combined concentration of all impurities is less than or equal to 0.4 wt. %.

Ti alloys having the disclosed compositions have the advantage of providing a low-cost Ti alloy which comprises a tensile yield strength (TYS) of at least about 120,000 pounds per square inch (psi) and an ultimate tensile strength (UTS) of at least about 128,000 psi in both longitudinal and transverse directions in combination with a reduction in area (RA) of at least about 43% and an elongation of at least about 12%. The Ti alloy may be formed into a plate which, in particular embodiment, has a thickness between about 0.425 inches and about 0.450 inches and a $V_{50}$ ballistic limit of at least about 1848 feet per second (fps). In an even more particular embodiment a plate of the Ti alloy has a thickness of about 0.430 inches and a $V_{50}$ ballistic limit of about 1936 fps.

In one embodiment, the Ti alloy has a ratio of beta isomorphous ($\beta_{ISO}$) to beta eutectoid ($\beta_{EUT}$) stabilizers ($\beta_{ISO}/\beta_{EUT}$) of about 0.9 to about 1.7, wherein the ratio of beta isomorphous to beta eutectoid stabilizers is defined as:

$$\frac{\beta_{ISO}}{\beta_{EUT}} = \frac{\mathrm{Mo} + \frac{\mathrm{V}}{1.5}}{\frac{\mathrm{Cr}}{0.65} + \frac{\mathrm{Fe}}{0.35}}.$$

In the equations provided throughout this specification, Mo, V, Cr and Fe respectively represent the weight percentage of molybdenum, vanadium, chromium and iron in the Ti alloy. In a particular embodiment, the ratio of beta isomorphous to beta eutectoid stabilizers is about 1.2.

In another embodiment, the Ti alloy has a molybdenum equivalence ($Mo_{eq}$) of about 3.1 to about 4.4, wherein the molybdenum equivalence is defined as:

$$Mo_{eq} = \mathrm{Mo} + \frac{\mathrm{V}}{1.5} + \frac{\mathrm{Cr}}{0.65} + \frac{\mathrm{Fe}}{0.35}.$$

In a particular embodiment, the molybdenum equivalence is about 3.8. In still another embodiment, the Ti alloy has an aluminum equivalence ($Al_{eq}$) of about 8.3 to about 10.5 wherein the aluminum equivalence is defined as:

$$Al_{eq}=\mathrm{Al}+27\mathrm{O}.$$

In this equation Al and O represent the weight percentage of aluminum and oxygen, respectively, in the Ti alloy. In a particular embodiment, the aluminum equivalence is about 9.4.

In another embodiment, the Ti alloy has a beta transformation temperature ($T_\beta$) of about 1732° F. to about 1820° F., wherein the beta transformation temperature in ° F. is defined as:

$$T_\beta=1607+39.3\mathrm{Al}+330\mathrm{O}+1145\mathrm{C}+1020\mathrm{N}-21.8\mathrm{V}-32.5\mathrm{Fe}-17.3\mathrm{Mo}-70\mathrm{Si}-27.3\mathrm{Cr}.$$

In this equation, C, N and Si represent the weight % of carbon, nitrogen and silicon, respectively, in the Ti alloy. In a particular embodiment, the beta transition temperature is about 1775° F. In one embodiment the density of the Ti alloy ranges from about 0.161 pounds per cubic inch ($lb/in^3$) to about 0.163 $lb/in^3$ and, in a particular embodiment, is about 0.162 $lb/in^3$.

In another embodiment, a method of manufacturing a Ti alloy consisting essentially of, in weight percent, 4.2 to 5.4% aluminum, 2.5 to 3.5% vanadium, 0.5 to 0.7% iron, 0.15 to 0.19% oxygen and balance titanium is disclosed. In a particular embodiment the Ti alloy is produced by melting a combination of recycled and/or virgin materials comprising the appropriate proportions of aluminum, vanadium, iron and titanium in a cold hearth furnace to form a molten alloy, and casting said molten alloy into a mold. The recycled materials may comprise, for example, Ti64 turnings and commercially pure (CP) titanium scrap. The virgin materials may comprise, for example, titanium sponge, iron powder and aluminum shot. In another particular embodiment the recycled materials comprise about 70.4% Ti64 turnings, about 28.0% titanium sponge, about 0.4% iron and about 1.1% aluminum shot.

In yet another embodiment the Ti alloy is cast into a rectangular mold to form a slab having a rectangular shape and a composition of, in weight percent, 4.2 to 5.4% aluminum, 2.5 to 3.5% vanadium, 0.5 to 0.7% iron, 0.15 to 0.19% oxygen and balance titanium. In a particular embodiment, the cast slab may be subjected to an initial forge or roll at a temperature above the beta transus temperature and a final roll at a temperature below the beta transus temperature before being annealed at a temperature below the beta transus temperature.

The Ti alloys disclosed in this specification provide a comparatively low-cost alternative to conventional Ti64 alloys while meeting or exceeding mechanical and ballistic properties established for Ti64 alloys. This reduction in cost will permit more widespread adoption of Ti alloys in a variety of military and other applications which require similar combinations of properties.

BRIEF DESCRIPTION OF THE DRAWINGS

The accompanying drawings, which are incorporated into and constitute part of this disclosure, illustrate exemplary embodiments of the disclosed invention and serve to explain the principles of the disclosed invention.

Figure 1:
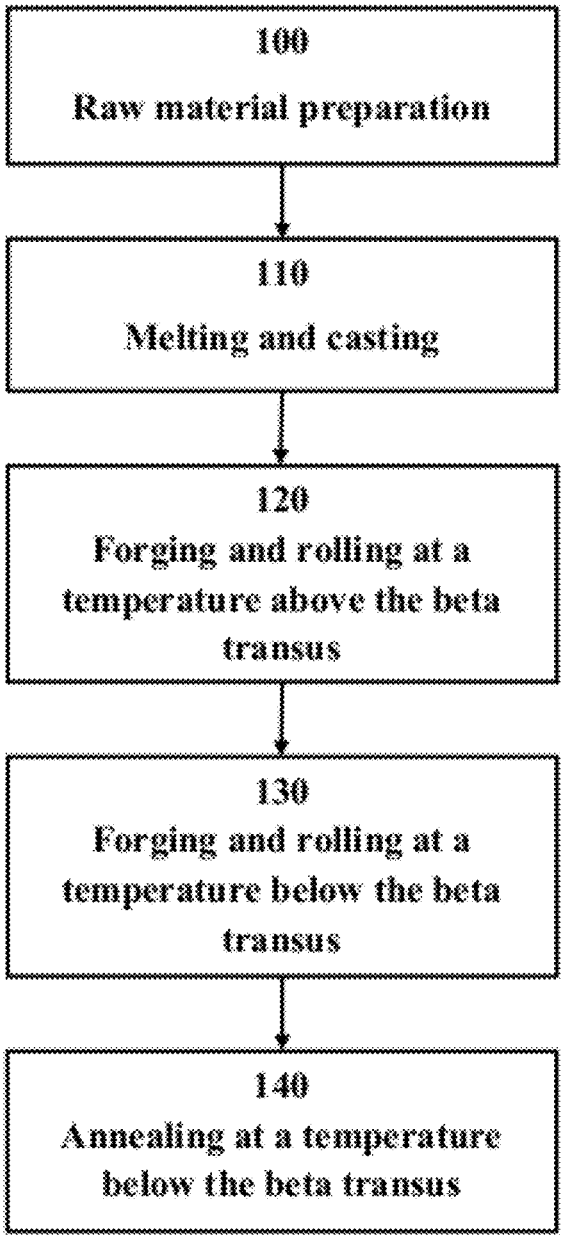
FIG. 1 is a flowchart illustrating a method of producing Ti alloys in accordance with an exemplary embodiment of the presently disclosed invention.

Throughout the drawings, the same reference numerals and characters, unless otherwise stated, are used to denote like features, elements, components or portions of the illustrated embodiments. While the disclosed invention is described in detail with reference to the figures, it is done so in connection with the illustrative embodiments.

DETAILED DESCRIPTION OF THE INVENTION

Exemplary Ti alloys having good mechanical and ballistic properties which are formed using comparatively low cost materials are described. These Ti alloys are especially suited for use as armor plate in military systems or for applications where a metallic alloy having an excellent strength-to-weight ratio and good resistance to penetration by projectiles upon impact is required. The disclosed Ti alloys achieve combinations of mechanical strength and ballistic properties which meet minimum military standards while lowering the compositional and processing costs. The lower raw material and processing costs will facilitate more widespread adoption of the disclosed Ti alloys due to their increasingly favorable cost considerations.

In one embodiment the exemplary Ti alloy includes, in weight percent, 4.2 to 5.4% aluminum, 2.5 to 3.5% vanadium, 0.5 to 0.7% iron, 0.15 to 0.19% oxygen, with balance titanium and incident impurities.

Aluminum as an alloying element in titanium is an alpha stabilizer, which increases the temperature at which the alpha phase is stable. In one embodiment, aluminum is present in the Ti alloy in a weight percentage of 4.2 to 5.4%. In a particular embodiment, aluminum is present in about 4.8 wt. %.

Vanadium as an alloying element in titanium is an isomorphous beta stabilizer which lowers the beta transformation temperature. In one embodiment, vanadium is present in the Ti alloy in a weight percentage of 2.5 to 3.5%. In a particular embodiment, vanadium is present in about 3.0 wt. %.

Iron as an alloying element in titanium is an eutectoid beta stabilizer which lowers the beta transformation temperature, and iron is a strengthening element in titanium at ambient temperatures. In one embodiment, iron is present in the Ti alloy in a weight percentage of 0.5 to 0.7%. In a particular embodiment, iron is present in about 0.6 wt. % If, however, the iron concentration were to exceed the upper limits disclosed in this specification, there can be excessive solute segregation during ingot solidification which will adversely affect ballistic and mechanical properties. On the other hand, the use of iron levels below the limits disclosed in this specification can produce an alloy which fails to achieve the desired strength and ballistic properties.

Oxygen as an alloying element in titanium is an alpha stabilizer, and oxygen is an effective strengthening element in titanium alloys at ambient temperatures. In one embodiment, oxygen is present in the Ti alloy in a weight percentage of 0.15 to 0.19%. In a particular embodiment, oxygen is present in about 0.17 wt. %. If the content of oxygen is too low, the strength can be too low, the beta transformation temperature can be too low and the cost of the Ti alloy can increase because scrap metal will not be suitable for use in the melting of the Ti alloy. On the other hand, if the oxygen content is too great, resistance to cracking after ballistic impact may be deteriorated.

In accordance with some embodiments of the present invention, the Ti alloy can also include unintentional impurities or other elements such as Mo, Cr, N, C, Nb, Sn, Zr, Ni, Co, Cu, Si and the like at concentrations associated with impurity levels. Nitrogen (N) may also be present in concentrations up to a maximum of 0.05 wt. %. In a particular embodiment, the maximum concentration of any one impurity element is 0.1 wt. % and the combined concentration of all impurities does not exceed a total of 0.4 wt. %.

In accordance with one embodiment, the Ti alloy has a ratio of beta isomorphous ($\beta_{ISO}$) to beta eutectoid ($\beta_{EUT}$) stabilizers ($\beta_{ISO}/\beta_{EUT}$) of about 0.9 to about 1.7, wherein the ratio of beta isomorphous to beta eutectoid stabilizers is defined in Equation (1) as:

$$\frac{\beta_{ISO}}{\beta_{EUT}} = \frac{\mathrm{Mo} + \frac{\mathrm{V}}{1.5}}{\frac{\mathrm{Cr}}{0.65} + \frac{\mathrm{Fe}}{0.35}}. \tag{1}$$

In the equations provided throughout this specification, Mo, V, Cr and Fe respectively represent the weight percentage of molybdenum, vanadium, chromium and iron in the Ti alloy. In a particular embodiment, the ratio of beta isomorphous to beta eutectoid stabilizers is about 1.2.

In accordance with another embodiment of the invention, the Ti alloy has a molybdenum equivalence ($Mo_{eq}$) of about 3.1 to about 4.4, wherein the molybdenum equivalence is defined in Equation (2) as:

$$Mo_{eq} = \mathrm{Mo} + \frac{\mathrm{V}}{1.5} + \frac{\mathrm{Cr}}{0.65} + \frac{\mathrm{Fe}}{0.35}. \tag{2}$$

In a particular embodiment, the molybdenum equivalence is about 3.8. Although Mo and Cr are not primary constituents of the disclosed Ti alloy, they may be present in trace concentrations (e.g., at or below impurity levels) and, hence, can be used to calculate $\beta_{ISO}/\beta_{EUT}$ and $Mo_{eq}$. In still another embodiment, the Ti alloy has an aluminum equivalence ($Al_{eq}$) of about 8.3 to about 10.5, wherein the aluminum equivalence is defined in Equation (3) as:

$$Al_{eq}=\mathrm{Al}+27\mathrm{O}. \tag{3}$$

In this equation, Al and O represent the weight percent of aluminum and oxygen, respectively, in the Ti alloy. In a particular embodiment, the aluminum equivalence is about 9.4.

In yet another embodiment, the Ti alloy has a beta transformation temperature ($T_\beta$) of about 1732 to about 1820° F., wherein the beta transformation temperature in ° F. is defined in Equation (4) as:

$$T_\beta=1607+39.3\mathrm{Al}+330\mathrm{O}+1145\mathrm{C}+1020\mathrm{N}-21.8\mathrm{V}-32.5\mathrm{Fe}-17.3\mathrm{Mo}-70\mathrm{Si}-27.3\mathrm{Cr}. \tag{4}$$

In this equation, C, N and Si represent the weight % of carbon, nitrogen and silicon, respectively, in the Ti alloy. As is the case for the molybdenum equivalence, although C, N and Si are not primary constituents of the Ti alloy, they may be present as incidental impurities. In a particular embodiment, the beta transition temperature is about 1775° F.

The Ti alloys achieve excellent tensile properties having, for example, a tensile yield strength (TYS) of at least about 120,000 pounds per square inch (psi) and an ultimate tensile strength (UTS) of at least about 128,000 psi along both transverse and longitudinal directions. In another embodiment, the Ti alloy has an elongation of at least about 12%, and/or a reduction of area (RA) of at least about 43%. The density of the Ti alloy is calculated to be between about 0.161 pounds per cubic inch (lb/in$^3$) and about 0.163 lb/in$^3$ with a nominal density of about 0.162 lb/in$^3$.

The Ti alloy also provides excellent ballistic properties. A measure of the effectiveness of ballistic plates is provided by the average velocity ($V_{50}$) of a shell or projectile required to penetrate the plate. For example, when formed into a plate having a thickness between about 0.425 and about 0.450 inches, the Ti alloy has a $V_{50}$ ballistic limit of at least about 1848 fps. In a particular embodiment, about an 0.430-inch-thick plate of the Ti alloy has a $V_{50}$ ballistic limit of about 1936 fps. The procedures used to test the $V_{50}$ ballistic limits of the Ti alloys are described with reference to the Examples provided below.

In accordance with another embodiment, a plate comprising the Ti alloy described in this disclosure is provided. In a particular embodiment, the Ti alloy presented herein is used as armored plate. However, other suitable applications for the Ti alloy include, but are not limited to, other components in military systems as well as automotive and aircraft parts such as seat tracks and erosion protection shields.

In yet another embodiment, a method for manufacturing a Ti alloy having good mechanical and ballistic properties is disclosed. The method includes melting a combination of source materials in the appropriate proportions to produce a Ti alloy consisting essentially of, in weight percent, 4.2 to 5.4% aluminum, 2.5 to 3.5% vanadium, 0.5 to 0.7% iron and 0.15 to 0.19% oxygen with balance titanium. Melting may be accomplished in, for example, a cold hearth furnace. In a particular embodiment, the source materials comprise a combination of recycled and virgin materials such as titanium scrap and titanium sponge in combination with small amounts of iron and aluminum. Under most market conditions, the use of recycled materials offers significant cost savings. The recycled materials used may include, but are not limited to, Ti64, Ti-10V-2Fe-3Al, other Ti—Al—V—Fe alloys, and CP titanium. Recycled materials may be in the form of machining chip (turnings), solid pieces, or remelted electrodes. The virgin materials used may include, but are not limited to, titanium sponge, an aluminum-vanadium master alloy, iron powder, or aluminum shot. Since no aluminum-vanadium master alloy is required, significant cost savings can be attained. This does not, however, preclude the use and addition of virgin raw materials comprising titanium sponge and alloying elements rather than recycled materials if so desired.

In some embodiments, the manufacturing method includes performing an annealing heat treatment of the Ti alloy at a subtransus temperature (e.g., below the beta transformation temperature). The Ti alloy used can have any of the properties described in this specification.

In some embodiments, the manufacturing method also includes vacuum arc remelting (VAR) the alloy and forging and/or rolling the Ti alloy above the beta transformation temperature followed by forging and/or rolling below the beta transformation temperature. In a particular embodiment, the method of manufacturing the Ti alloy is used to produce components for military systems, and even more specifically, to produce armor plate.

A flowchart which shows an exemplary method of manufacturing the Ti alloys is provided in FIG. 1. Initially, the desired quantity of raw materials having the appropriate concentrations and proportions are prepared in step 100. In a particular embodiment the raw materials comprise recycled materials although they may be combined with virgin raw materials of the appropriate composition in any combination. After preparation, the raw materials are melted and cast to produce an ingot in step 110. Melting may be accomplished by, for example, VAR, plasma arc melting, electron beam melting, consumable electrode scull melting or combinations thereof. In a particular embodiment double melt ingots are prepared by VAR and are cast directly into a mold having a round shape.

In step 120, the ingot is subjected to initial forging and rolling. The initial forging and rolling is performed above the beta transformation temperature (beta transus) with rolling being performed in the longitudinal direction. In step 130 the ingot is subject to final forging and rolling. The final forging and rolling is performed below the beta transformation temperature (beta transus) with rolling being performed in the longitudinal and transverse directions. The ingot is then annealed in step 140 which, in a particular embodiment, is performed at a subtransus temperature. The final rolled product may have a thickness which ranges from, but is not limited, to about 0.1 inches to about 4.1 inches.

In some embodiments, rolling to gages below 0.4 inches may be accomplished by hot rolling and optionally cold rolling to produce a coil or strip product. In yet another embodiment, rolling to thin gage sheet products may be accomplished by hot or cold rolling of sheets as single sheets or as multiple sheets encased in steel packs.

Additional details on the exemplary titanium alloys and methods for their manufacture described in the Examples which follow.

Exemplary Embodiments:

The examples provided in this section serve to illustrate the processing steps used, resulting composition and subsequent properties of Ti alloys prepared according to embodiments of the present invention. The Ti alloys and their associated methods of manufacture which are described below are provided as examples and are not intended to be limiting.

COMPARATIVE EXAMPLES

Several Ti alloys having elemental concentrations outside the V, Fe and O ranges disclosed in this specification were initially prepared to serve as comparative examples. The comparative Ti alloys were formed by mixing together raw materials to achieve the appropriate proportions for each comparative Ti alloy. Comparative Ti alloy #C1 was prepared with a nominal composition of about 5.0 wt. % aluminum, about 4.0 wt. % vanadium, about 0.03 wt. % iron, about 0.22 wt. % oxygen and balance titanium. Comparative Ti alloy #C2 was prepared with a nominal composition of about 5.0 wt. % aluminum, about 4.0 wt. % vanadium, about 0.03 wt. % iron, about 0.12 wt. % oxygen and balance titanium. Comparative Ti alloy #C3 was prepared with a nominal composition of about 5.0 wt. % aluminum, about 5.0 wt. % vanadium, about 0.6 wt. % iron, about 0.19 wt. % oxygen and balance titanium.

Comparative Ti alloys #C1-C3 were cast into individual ingots having a round shape and were converted to intermediate slabs from above the beta transus temperature. Final rolling and cross rolling were performed below the beta transus temperature. A final anneal was performed at a temperature below the beta transus temperature. Comparative Ti alloys #C1-C3 were subject to a final anneal at a temperature of 1400° F. for two hours and the samples were allowed to cool in air.

A chemical analysis was performed on comparative Ti alloys #C1-C3 and their mechanical and ballistic properties were measured. The measured compositions and calculated $Al_{eq}$, $Mo_{eq}$, $T_\beta$, and density values are summarized in Table 1 below:

TABLE 1

Chemical compositions and parameters for comparative Ti Alloys #C1-C3

| Ti | Element (wt. %) | | | | | Calculated Parameter | | | |
|---|---|---|---|---|---|---|---|---|---|
| | | | | | | | | $T_\beta$ | ρ |
| Alloy | Al | V | Fe | O | N | $Al_{eq}$ | $Mo_{eq}$ | (° F.) | (lb/in$^3$) |
| C1 | 4.98 | 4.1 | 0.03 | 0.22 | 0.003 | 11.0 | 2.8 | 1796 | 0.161 |
| C2 | 4.95 | 4.1 | 0.03 | 0.12 | 0.001 | 8.1 | 2.8 | 1761 | 0.162 |
| C3 | 4.81 | 4.92 | 0.58 | 0.19 | 0.002 | 9.9 | 5.0 | 1742 | 0.163 |

The mechanical properties of plates comprised of comparative Ti alloys #C1-C3 were measured and are summarized in Table 2. A plurality of measurements were obtained from a single ingots and the results are provided on separate rows within the same group in Table 2. The tensile properties of the plates were measured in both transverse (T) and longitudinal (L) directions. Within Table 2, ksi represents kilopounds per square inch (1 ksi=1,000 psi). The tensile properties measured in Table 2 yield average UTS, TYS, RA, and Elongation values of 131 ksi, 122.3 ksi, 36% and 10.3%, respectively, for comparative Ti alloy #C1; 131 ksi, 123 ksi, 34% and 11%, respectively, for comparative Ti alloy #C2; and 133.8 ksi, 124.3 ksi, 42% and 12.3%, respectively for comparative Ti alloy #C3.

TABLE 2

Summary of tensile properties for comparative Ti alloys #C1-C3

| Ti Alloy | Nominal Composition (wt. %) | Orientation | Tensile Properties UTS (ksi) | TYS (ksi) | RA (%) | Elongation (%) |
|---|---|---|---|---|---|---|
| C1(a) | 5Al4V.03Fe.22O | L | 133 | 124 | 35 | 11 |
| C1(b) | 5Al4V.03Fe.22O | L | 129 | 121 | 37 | 11 |
| C1(c) | 5Al4V.03Fe.22O | T | 131 | 122 | 36 | 9 |
| C2(a) | 5Al4V.03Fe.12O | L | 131 | 123 | 35 | 11 |
| C2(b) | 5Al4V.03Fe.12O | L | 131 | 123 | 33 | 11 |
| C2(c) | 5Al4V.03Fe.12O | T | 131 | 123 | 34 | 11 |
| C3(a) | 5Al5V.6Fe.19O | L | 135 | 125 | 43 | 12 |
| C3(b) | 5Al5V.6Fe.19O | L | 135 | 125 | 43 | 13 |
| C3(c) | 5Al5V.6Fe.19O | T | 133 | 124 | 38 | 12 |
| C3(d) | 5Al5V.6Fe.19O | T | 132 | 123 | 44 | 12 |

Figure 2A:
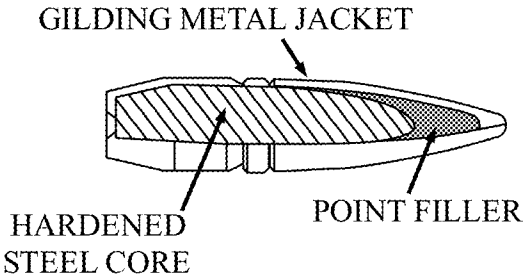
FIG. 2A is a schematic of an actual armor-piercing .30 caliber M2 projectile.
Figure 2B:
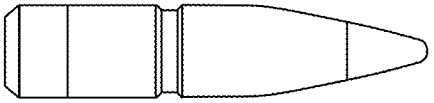
FIG. 2B is a side view of an armor-piercing .30 caliber M2 projectile representative of an actual projectile used in testing.

The minimum protection $V_{50}$ ballistic limits of the comparative Ti alloy plates were measured using .30 caliber (7.62 mm) 166-grain armor piercing (AP) M2 ammunition. A cross-sectional schematic of a 0.30 AP M2 round is provided in FIG. 2A whereas an actual sample is shown in FIG. 2B. The .30 caliber ammunition includes a hardened steel core, point filler and gilding metal jacket. Ballistic testing itself was performed in accordance with standard military test procedures as disclosed, for example, by the U.S. Department of Defense in "Military Standard: $V_{50}$ Ballistic Test for Armor," MIL-STD-662E, 2006.

Figure 3:
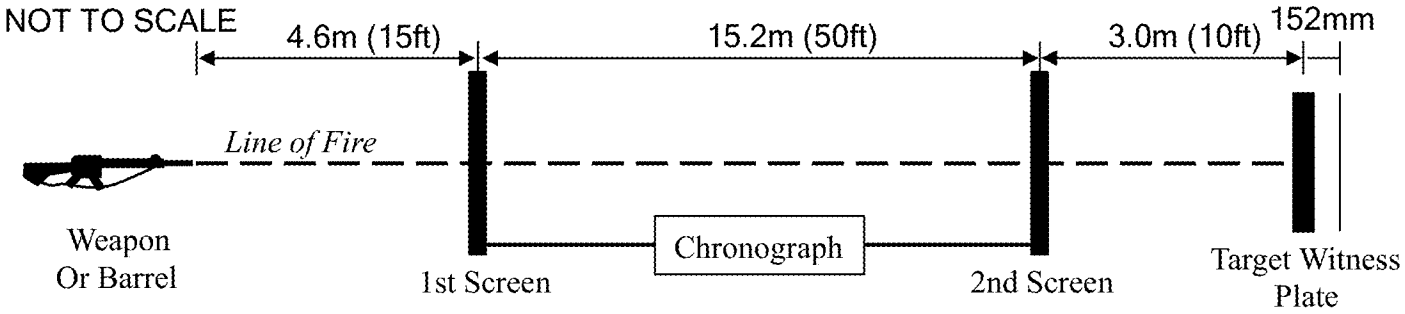
FIG. 3 illustrates the test range configuration used for $V_{50}$ ballistic limit testing of armor plates.

A schematic of the test range configuration used for $V_{50}$ ballistic limit testing of armor plate is shown in FIG. 3. A first and second photoelectric screen was used in conjunction with chronographs to calculate projectile velocities at a point halfway between the muzzle of the weapon and the target. Testing was performed at zero degree obliquity under ambient conditions (70-75° F. (21-24° C.) and 35-75% relative humidity). The reported thickness value of each plate is the average of the thicknesses measured at each corner of the plate. A 0.020-inch-thick (0.51 mm) 2024-T3 aluminum witness plate was placed 6 inches (152 mm) behind the target plate. Any perforation of the witness plate was defined as a complete penetration of the armor test sample.

Figure 4:
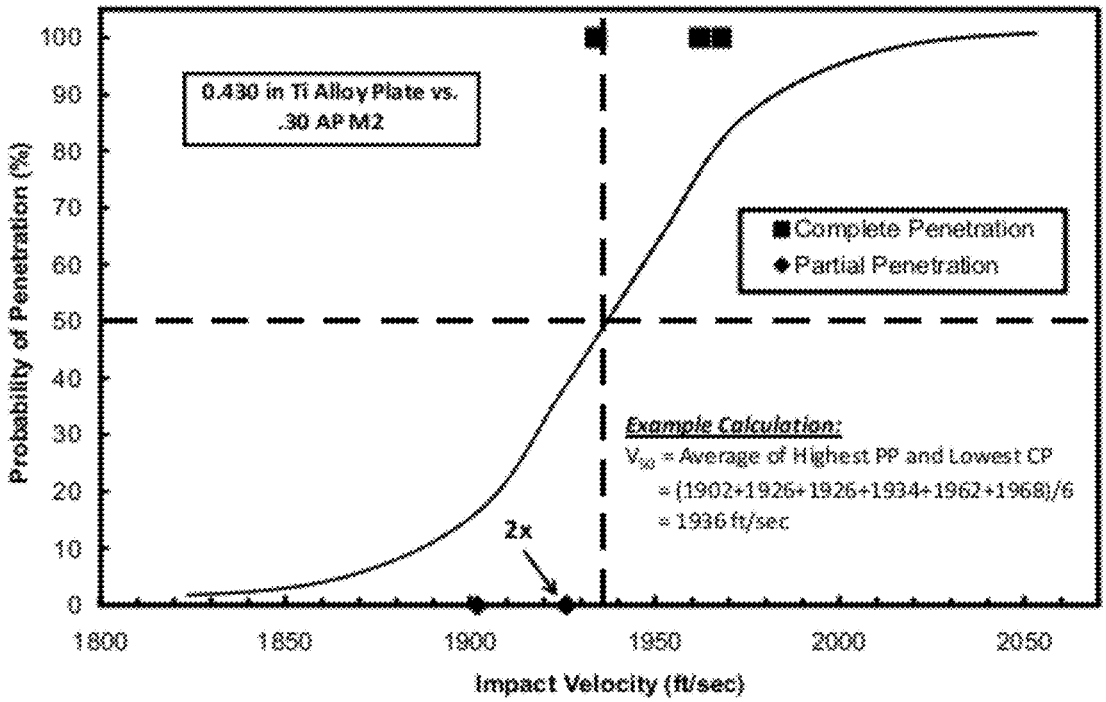
FIG. 4 is an example showing the probability of penetration of an armor plate versus the projectile velocity as measured at the midpoint between the muzzle and the armor plate.

Each test consisted of firing projectiles at various velocities and then assessing whether a particular impact resulted in complete penetration (i.e., perforation of the witness plate) or partial penetration. The average of the velocities of the lowest complete penetrations and the highest partial penetrations was then used to estimate a value for $V_{50}$. The results of a sample calculation are provided in FIG. 4 which is a plot showing the probability of penetration (%) as a function of the impact velocity (ft/sec or fps) for a 0.430-inch-thick Ti alloy plate. The method of manufacture, composition, and properties of the Ti alloy plate tested in FIG. 4 are provided in Example #1 below. Solid diamonds in FIG. 4 represent rounds which partially penetrated (PP) the plate whereas solid squares represent complete penetration (CP) of the plate. A value for $V_{50}$ is calculated by averaging the impact velocities producing CP with those producing PP. The example in FIG. 4 provides a value of $V_{50}$=1936 fps. The $V_{50}$ value is therefore a convenient number to generate and is widely used to quantify the ballistic protection provided by a given type of armor against a given threat.

The comparative Ti alloys were processed to form plates having thicknesses of about 0.440 inches for comparative Ti alloy #C1, about 0.449 inches for comparative Ti alloy #C2 and about 0.426 inches for comparative Ti alloy #C3. The ballistic properties of each of comparative Ti alloys #C1-C3 were measured according to U.S. Department of Defense standards as defined above with reference to FIGS. 2-4 and the results are summarized in Table 3 below. The $V_{50}$ ballistic limit for comparative Ti alloys #C1-C3 was measured to be about 1922 fps, about 1950 fps and about 1888 fps, respectively.

Ballistics data calculated for Ti64 alloys having plate thicknesses identical to the experimental value obtained for comparative Ti Alloys #C1-C3 is also provided in Table 3. The improvement in $V_{50}$ obtained between each comparative Ti alloy over the calculated $V_{50}$ value for Ti64 is labeled as "Δ vs. Ti64" and is included in the right-hand column in Table 3. The $V_{50}$ values for Ti alloys #C1-C3 exceed calculated values for Ti64 plates having the same thicknesses by 10, 12 and 16 fps, respectively. The minimum $V_{50}$ values provided in Table 3 represent the minimum $V_{50}$ required by the U.S. Department of Defense in MIL-DTL-46077G, 2006 for the specified plate thicknesses. For example, a plate thickness of 0.440 inches requires a minimum $V_{50}$ of 1895 fps. The $\Delta V_{50}$ values provided in Table 3 represent the difference between minimum $V_{50}$ and measured $V_{50}$ values for each comparative Ti alloy.

TABLE 3

Summary of ballistic results for comparative Ti alloys #C1-C3

| Ti Alloy | Nominal Composition (wt. %) | $V_{50}$ Results for Noted Alloy t (in) | $V_{50}$ min (fps) | $V_{50}$ (fps) | $\Delta V_{50}$ (fps) | Calculated $V_{50}$ For Ti64 t (in) | $V_{50}$ min (fps) | $V_{50}$ (fps) | $\Delta V_{50}$ (fps) | Δ vs. Ti64 (fps) |
|---|---|---|---|---|---|---|---|---|---|---|
| C1 | 5Al4V.03Fe.22O | 0.440 | 1895 | 1922 | 27 | 0.440 | 1895 | 1912 | 17 | 10 |
| C2 | 5Al4V.03Fe.12O | 0.449 | 1922 | 1950 | 28 | 0.449 | 1922 | 1938 | 16 | 12 |
| C3 | 5Al5V.6Fe.19O | 0.426 | 1851 | 1888 | 37 | 0.426 | 1851 | 1872 | 21 | 16 |

Example #1

An exemplary Ti alloy identified as Ti alloy #1 having a nominal composition of about 5.0 wt. % aluminum, about 3.0 wt. % vanadium, about 0.6 wt. % iron, about 0.19 wt. % oxygen and balance titanium was prepared by initially mixing together raw materials to achieve the correct proportions. A cost analysis of the above formulation revealed that a finished slab costs significantly less per pound than conventional Ti64 alloys prepared by electron-beam single-melting. The raw materials were prepared into 6.5-inch-diameter double melt ingots by VAR.

Ti alloy #1 is processed in the same manner as comparative Ti alloys #C1-C3. Ti alloy #1 is cast into an ingot and is converted to an intermediate slab from above the beta transus temperature. Final rolling and cross rolling is then performed below the beta transus temperature. A final anneal is performed at a temperature below the beta transus temperature. In this embodiment, a final anneal was performed at 1400° F. for two hours and the sample was allowed to cool in air.

A chemical analysis was performed on the resulting Ti alloy #1 plate and the mechanical properties were measured. Ti alloy #1 was found to have a composition of 4.82 wt. % aluminum, 2.92 wt. % vanadium, 0.61 wt. % iron, 0.19 wt. % oxygen and balance titanium. Nitrogen was also found to be present in a concentration of 0.001 wt. %. The Ti alloy plate also had a ratio of beta isomorphous ($\beta_{ISO}$) to beta eutectoid ($\beta_{EUT}$) stabilizers ($\beta_{ISO}/\beta_{EUT}$) of 1.2, an aluminum equivalence $Al_{eq}$ of 10.0, a molybdenum equivalence $Mo_{eq}$ of 3.7, a beta transition temperature $T_\beta$ of 1786° F., and a density of 0.162 lb/in$^3$. The tensile properties of the plate were measured in both transverse (T) and longitudinal (L) directions with a plurality of measurements being performed on the same sample. The results of these measurements are provided in Table 4 below. The tensile properties measured in Table 4 yield an average UTS of 129 ksi, an average TYS of 121 ksi, average RA of 47.5%, and an average elongation of 13%.

TABLE 4

Summary of tensile properties for Ti alloy #1

| Nominal Composition (wt. %) | Tensile Properties | | | | |
|---|---|---|---|---|---|
| | Orientation | UTS (ksi) | TYS (ksi) | RA (%) | Elongation (%) |
| 5Al3V0.6Fe0.19O | L | 129 | 121 | 58 | 14 |
| 5Al3V0.6Fe0.19O | L | 130 | 122 | 45 | 13 |
| 5Al3V0.6Fe0.19O | T | 128 | 120 | 44 | 12 |
| 5Al3V0.6Fe0.19O | T | 129 | 121 | 43 | 13 |

An exemplary Ti alloy #1 having a composition of 4.82 wt. % aluminum, 2.92 wt. % vanadium, 0.61 wt. % iron, 0.19 wt. % oxygen and balance titanium was processed to yield a plate having a thickness of about 0.430 inches. The $V_{50}$ value for Ti alloy #1 was measured to be about 1936 fps. This exceeds the minimum of 1864 fps established by the U.S. Department of Defense for 0.430-inch-thick armor plate by a range $\Delta V_{50}$ of 72 fps.

Figure 5:
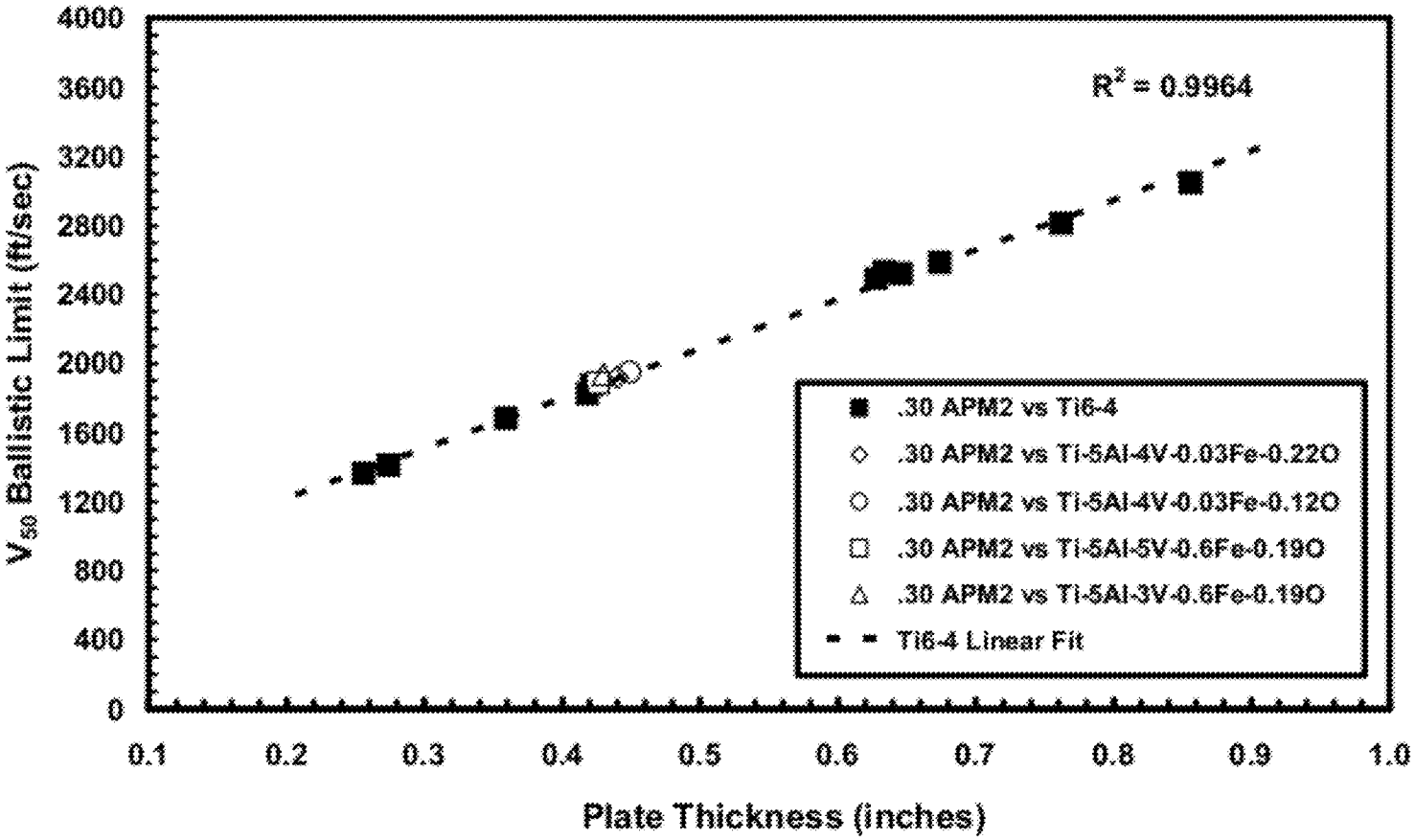
FIG. 5 is a plot showing the $V_{50}$ ballistic limit as a function of plate thickness for exemplary Ti alloys.
Figure 6:
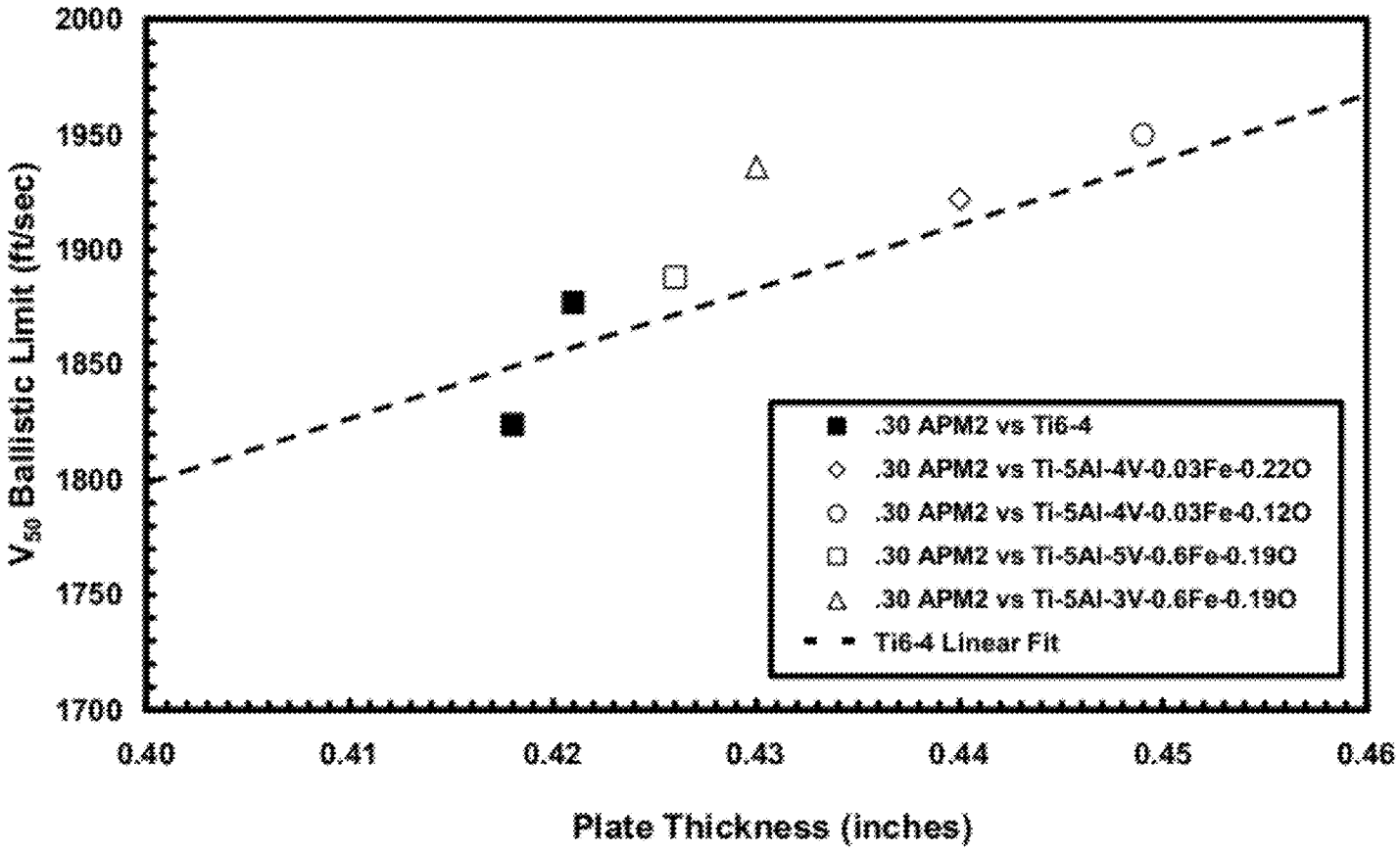
FIG. 6 is an enlarged view of FIG. 5 over the thickness range of 0.40 to 0.46 inches showing the $V_{50}$ ballistic limit as a function of plate thickness for exemplary Ti alloys.

The ballistics data obtained for comparative Ti alloys #C1-C3 and Ti alloy #1 was plotted in FIG. 5 and compared with previous results obtained for Ti64 alloys as disclosed, for example, by J. C. Fanning in "Ballistic Evaluation of TIMETAL 6-4 Plate for Protection Against Armor Piercing Projectiles," Proceedings of the Ninth World Conference on Titanium, Vol. II, pp. 1172-78 (1999), which is incorporated by reference in its entirety as if fully set forth in this specification. A strong linear correlation between $V_{50}$ and the plate thickness was developed for Ti64 alloys as shown by the dotted line which is a best-fit ($R^2$=0.9964) to the Ti64 data. An enlarged view of FIG. 5 which shows $V_{50}$ values obtained for plate thicknesses ranging from 0.40 to 0.46 inches is provided in FIG. 6. Data obtained for exemplary Ti alloy #1 is shown as an open triangle in FIGS. 5-6. Although each of comparative Ti alloys #C1-C3 and Ti alloy #1 showed an enhancement in $V_{50}$ compared to conventional Ti64 alloys of identical thickness, the results in FIGS. 5-6 show that the largest increase was obtained for Ti alloy #1. That is, exemplary Ti alloy #1 exceeded the Ti64 values by a greater margin than all other alloys. It also exceeded the predicted $V_{50}$ value of 1883 fps for Ti64 alloys by 53 fps which is a significant margin.

Thus the exemplary Ti alloys disclosed in this specification having a composition consisting essentially of, in weight percent, 4.2 to 5.4% aluminum, 2.5 to 3.5% vanadium, 0.5 to 0.7% iron and 0.15 to 0.19% oxygen with balance titanium provide a low-cost composition having mechanical and ballistic properties which are equal to or better than conventional Ti64 alloys. The mechanical and ballistic properties attained exceed military specifications for class 4 armor plate as per U.S. Department of Defense specifications in "Detail Specification: Armor Plate, Titanium Alloy, Weldable," MIL-DTL-46077G, 2006. The exemplary Ti alloys disclosed in this specification have the advantage of providing a lower-cost composition and route to the fabrication of Ti alloys which are particularly well suited for use as armor plate in military systems.

In the interest of clarity, in describing embodiments of the present invention, the following terms are defined as provided below. All tensile tests were performed according to ASTM E8 standards whereas ballistic testing was performed in accordance with U.S. Department of Defense test procedures in "Military Standard: $V_{50}$ Ballistic Test for Armor," MIL-STD-662E, 2006.

- Tensile Yield Strength: Engineering tensile stress at which the material exhibits a specified limiting deviation (0.2%) from the proportionality of stress and strain.
- Ultimate Tensile Strength: The maximum engineering tensile stress which a material is capable of sustaining, calculated from the maximum load during a tension test carried out to rupture and the original cross-sectional area of the specimen.
- Modulus of Elasticity: During a tension test, the ratio of stress to corresponding strain below the proportional limit.
- Elongation: During a tension test, the increase in gage length (expressed as a percentage of the original gage length) after fracture.
- Reduction in Area: During a tension test, the decrease in cross-sectional area of a tensile specimen (expressed as a percentage of the original cross-sectional area) after fracture.
- $V_{50}$ Ballistic Limit: The average velocity of a specified projectile type that is required to penetrate an alloy plate having specified dimensions and positioned relative to the projectile firing point in a specified manner. $V_{50}$ is calculated by averaging the impact velocities producing complete penetration with those producing partial penetration.
- Alpha stabilizer: An element which, when dissolved in titanium, causes the beta transformation temperature to increase.

Beta stabilizer: An element which, when dissolved in titanium, causes the beta transformation temperature to decrease.

Beta transformation temperature: The lowest temperature at which a titanium alloy completes the allotropic transformation from an α+β to a β crystal structure. This is also known as the beta transus.

Eutectoid compound: An intermetallic compound of titanium and a transition metal that forms by decomposition of a titanium-rich β phase.

Isomorphous beta stabilizer: A β stabilizing element that has similar phase relations to β titanium and does not form intermetallic compounds with titanium.

Eutectoid beta stabilizer: A β stabilizing element capable of forming intermetallic compounds with titanium.

It will be appreciated by persons skilled in the art that the present invention is not limited to what has been particularly shown and described hereinabove. Rather, the scope of the present invention is defined by the claims which follow. It should further be understood that the above description is only representative of illustrative examples of embodiments. For the reader's convenience, the above description has focused on a representative sample of possible embodiments, a sample that teaches the principles of the present invention. Other embodiments may result from a different combination of portions of different embodiments.

The description has not attempted to exhaustively enumerate all possible variations. The alternate embodiments may not have been presented for a specific portion of the invention, and may result from a different combination of described portions, or that other undescribed alternate embodiments may be available for a portion, is not to be considered a disclaimer of those alternate embodiments. It will be appreciated that many of those undescribed embodiments are within the literal scope of the following claims, and others are equivalent. Furthermore, all references, publications, U.S. patents and U.S. patent application Publications cited throughout this specification are hereby incorporated by reference in their entirety as if fully set forth in this specification.

All percentages provided are in percent by weight (wt. %) in both the specification and claims.

What is claimed is:

1. A ballistic titanium alloy consisting essentially of, in weight percent, 4.2 to 5.4% aluminum, 2.5 to 3.5% vanadium, 0.5 to 0.7% iron, 0.15 to 0.19% oxygen and balance titanium and incidental impurities.

2. The titanium alloy of claim 1 wherein said alloy consists essentially of, in weight percent, about 4.8% aluminum, about 3.0% vanadium, about 0.6% iron, about 0.17% oxygen and balance titanium.

3. The titanium alloy of claim 1 wherein said alloy has a ratio of beta isomorphous ($\beta_{ISO}$) to beta eutectoid ($\beta_{EUT}$) stabilizers ($\beta_{ISO}/\beta_{EUT}$) of about 0.9 to about 1.7, in which $\beta_{ISO}/\beta_{EUT}$ is defined as $$\frac{\beta_{ISO}}{\beta_{EUT}} = \frac{\mathrm{Mo} + \frac{\mathrm{V}}{1.5}}{\frac{\mathrm{Cr}}{0.65} + \frac{\mathrm{Fe}}{0.35}}$$

and Mo, V, Cr and Fe represent the weight percentage of molybdenum, vanadium, chromium and iron, respectively, in the alloy.

4. The titanium alloy of claim 3 wherein said alloy has a ratio of beta isomorphous ($\beta_{ISO}$) to beta eutectoid ($\beta_{EUT}$) stabilizers ($\beta_{ISO}/\beta_{EUT}$) of about 1.2.

5. The titanium alloy of claim 1 wherein said alloy has a molybdenum equivalence $Mo_{eq}$ of about 3.1 to about 4.4, in which $Mo_{eq}$ is defined as $$Mo_{eq} = \mathrm{Mo} + \frac{\mathrm{V}}{1.5} + \frac{\mathrm{Cr}}{0.65} + \frac{\mathrm{Fe}}{0.35},$$

and Mo, V, Cr and Fe represent the weight percentage of molybdenum, vanadium, chromium and iron, respectively, in the alloy.

6. The titanium alloy of claim 5 wherein said alloy has a molybdenum equivalence $Mo_{eq}$ of about 3.8.

7. The titanium alloy of claim 1 wherein said alloy has an aluminum equivalence $Al_{eq}$ of about 8.3 to about 10.5, in which $Al_{eq}$ is defined as $$Al_{eq}=\mathrm{Al}+27\mathrm{O},$$

and Al and O represent the weight percentage of aluminum and oxygen, respectively, in the alloy.

8. The titanium alloy of claim 7 wherein said alloy has an aluminum equivalence $Al_{eq}$ of about 9.4.

9. The titanium alloy of claim 1 wherein said alloy has a beta transformation temperature ($T_\beta$) of about 1732° F. to about 1820° F.

10. The titanium alloy of claim 9 wherein said alloy has a beta transformation temperature ($T_\beta$) of about 1775° F.

11. The titanium alloy of claim 1 wherein a maximum concentration of any one impurity element present in the titanium alloy is 0.1 wt. % and the combined concentration of all impurities is less than or equal to 0.4 wt. %.

12. The titanium alloy of claim 1 wherein said alloy comprises a tensile yield strength of at least 120,000 psi and an ultimate tensile strength of at least 128,000 psi in both longitudinal and transverse directions, a reduction in area of at least 43% and an elongation of at least 12%.

13. A plate comprising the titanium alloy of claim 1.

14. The plate of claim 13 wherein a plate thickness is between about 0. 425 inches and about 0.450 inches.

15. The plate of claim 14 wherein said plate comprises a $V_{50}$ ballistic limit of at least 1848 fps.

16. The plate of claim 15 wherein said plate has a thickness of about 0. 430 inches and a $V_{50}$ ballistic limit of about 1936 fps.

17. A ballistic titanium alloy consisting of, in weight percent, 4.2 to 5.4% Al, 2.5 to 3.5% V, 0.5 to 0.7% Fe, 0.17 to 0.19% O, incidental impurities not exceeding 0.4%, and balance titanium, having an ultimate tensile strength of at least 128,000 psi and a $V_{50}$ ballistic limit of about 1936 fps when processed to a 0.43 inch thick plate.

18. A method of manufacturing a ballistic titanium alloy consisting essentially of, in weight percent, 4.2 to 5.4% aluminum, 2.5 to 3.5% vanadium, 0.5 to 0.7% iron, 0.15 to 0.19% oxygen and balance titanium and incidental impurities comprising:

melting a combination of recycled materials comprising the appropriate proportions of aluminum vanadium, iron, and titanium in a cold hearth furnace to form a molten alloy; and casting said molten alloy into a mold.

19. The method of claim 18 wherein the recycled materials comprise Ti64 turnings, titanium sponge, iron and aluminum shot.

20. The method of claim 19 wherein the recycled materials comprise about 70.4% Ti64 turnings, about 28.0% titanium sponge, about 0.4% iron and about 1.1% aluminum shot.

21. The method of claim 19 wherein the recycled materials comprise Ti64 turnings, commercially pure titanium scrap and high iron sponge.

22. The method of claim 18 wherein said molten alloy is cast into a rectangular mold to form a slab having a rectangular shape.

23. The method of claim 22 further comprising:

subjecting the slab .s to an initial roll above the beta transus temperature;

a final roll at a temperature below the beta transus temperature; and performing a final anneal of the plate at a temperature below the beta transus temperature.

24. The method of claim 23 wherein the final anneal is performed at 1400° F. and the plate is allowed to cool to room temperature in ambient air.

* * * * *